US007134571B2

(12) United States Patent
Hochtritt et al.

(10) Patent No.: US 7,134,571 B2
(45) Date of Patent: Nov. 14, 2006

(54) ABSORBENT SHEET PRODUCTS DISPENSER HAVING INTERCHANGEABLE FACE PLATES

(75) Inventors: Robert C Hochtritt, Neenah, WI (US); Andrew M Conger, Neenah, WI (US)

(73) Assignee: SCA Tissue North America LLC., Neenah, WI (US)

( * ) Notice: Subject to any disclaimer, the term of this patent is extended or adjusted under 35 U.S.C. 154(b) by 0 days.

(21) Appl. No.: 11/336,779

(22) Filed: Jan. 23, 2006

(65) Prior Publication Data

US 2006/0118568 A1 Jun. 8, 2006

Related U.S. Application Data

(62) Division of application No. 10/660,656, filed on Sep. 12, 2003, now Pat. No. 6,988,635.

(51) Int. Cl.
*A47K 10/24* (2006.01)

(52) U.S. Cl. ..... 221/44; 221/45; 221/33; 221/47; 221/63; 221/46; 221/199; 221/241; 221/242; 221/303; 221/304; 221/307; 221/308; 221/310; 312/50

(58) Field of Classification Search ..... 221/33, 221/38, 45, 46, 47, 48, 154, 155, 186, 281, 221/282, 283, 284, 285
See application file for complete search history.

(56) References Cited

U.S. PATENT DOCUMENTS

| | | | | |
|---|---|---|---|---|
| 3,028,047 | A | 4/1962 | Tuft | |
| 5,102,007 | A * | 4/1992 | Petterson et al. | 221/6 |
| 5,131,561 | A | 7/1992 | Casperson et al. | |
| 6,334,544 | B1 * | 1/2002 | Christensen et al. | 221/63 |
| 6,415,949 | B1 | 7/2002 | Tramontina | |
| 6,988,635 | B1 * | 1/2006 | Hochtritt et al. | 221/44 |
| 2003/0062375 | A1 * | 4/2003 | Christensen et al. | 221/46 |
| 2004/0206768 | A1 * | 10/2004 | Tramontina et al. | 221/46 |
| 2005/0087541 | A1 * | 4/2005 | Hochtritt et al. | 221/33 |
| 2006/0027590 | A9 * | 2/2006 | Tramontina et al. | 221/46 |

* cited by examiner

*Primary Examiner*—Gene O. Crawford
*Assistant Examiner*—Michael Collins
(74) *Attorney, Agent, or Firm*—Young & Thompson

(57) ABSTRACT

A napkin dispenser has a container body for holding a stack of napkins, and a pair of interchangeable face plates each connectable to the container body. One of the face plates has a first elongated dispensing opening exposing a bottom region of the napkin stack, for one-by-one dispensing, and the other face plate has a second elongated dispensing opening exposing an edge region of the napkin stack, for dispensing a plurality of napkins simultaneously.

11 Claims, 5 Drawing Sheets

ABSORBENT SHEET PRODUCTS DISPENSER HAVING INTERCHANGEABLE FACE PLATES

BACKGROUND OF THE INVENTION

1. Field of the Invention

The invention relates to a dispenser having interchangeable face plates for providing plural dispensing modes for folded absorbent sheet products.

2. Description of Related Art

Various solutions have been proposed to provide dual dispensing modes in a dispenser for folded paper products. In U.S. Pat. No. 4,623,074, a carton of facial tissue is provided with a single opening configured to permit withdrawing tissues one-by-one from the top of the carton, or in a group from the side of the carton.

U.S. Pat. No. 6,415,949 describes a cartridge filled with paper napkins, used as an insert into a surrounding housing structure. The cartridge is reversible within the housing structure such that, when inserted one way, a first dispensing throat is exposed through which the napkins are withdrawn one-by-one, and, when inserted the opposite way, a second dispensing throat is exposed through which napkins may be withdrawn in groups.

U.S. Pat. No. 5,131,561 describes a napkin dispenser with interchangeable face plates, but these are configured merely to permit a single dispenser to store various styles and/or sizes of folded paper napkins, rather than to provide plural dispensing modes.

The approach taken to dual dispensing modes in U.S. Pat. No. 6,415,949 has the disadvantage that it requires the napkins to be supplied in pre-filled cartridges. That approach has a tendency to increase the ratio of waste product to useable product, in that, if it is desired to refill the dispenser before it has completely run out of napkins, the remaining napkins in the nearly spent cartridge will typically be discarded, as adding them to another cartridge would require the user to rip open the old and new cartridges.

SUMMARY OF THE INVENTION

It is therefore an object of the invention to address and alleviate, at least in part, the disadvantages described above in connection with the prior art, by providing a dispenser for folded absorbent sheet products that has a body portion closed by interchangeable face plates, wherein one face plate permits withdrawing absorbent sheet products from the dispenser one-by-one, and another face plate permits withdrawing a group of the absorbent sheet product from the dispenser simultaneously.

According to the invention, a dispenser for folded absorbent sheet products comprises a container body for holding a stack of said absorbent sheet products, and at least two interchangeable face plates each connectable to the container body and each, when connected to said container body, partially closing said container at one end. A first of the interchangeable face plates has a first elongated dispensing opening exposing a bottom region of said stack, thereby to permit dispensing of absorbent sheet products one-by-one, and a second of the interchangeable face plates has a second elongated dispensing opening exposing a side region of the stack, thereby to permit dispensing a plurality of folded absorbent sheet products simultaneously.

The invention pertains to the dispenser proper, i.e., with or without folded absorbent sheet products contained therein.

The folded absorbent sheet products to be used in the dispenser according to the invention are preferably, but not necessarily, a stack of interfolded paper napkins, as explained herein. It is further preferred that each of the paper napkins within the stack is quarter-folded.

BRIEF DESCRIPTION OF THE DRAWINGS

Other objects, features and advantages of the invention will become more apparent after reading the following detailed description of preferred embodiments of the invention, given with reference to the accompanying drawings, in which:

FIG. 4(*b*) is a schematic cross-sectional view of the napkin stack housed in the dispenser of FIG. 1;

DETAILED DESCRIPTION OF PREFERRED EMBODIMENTS

Figure 1:
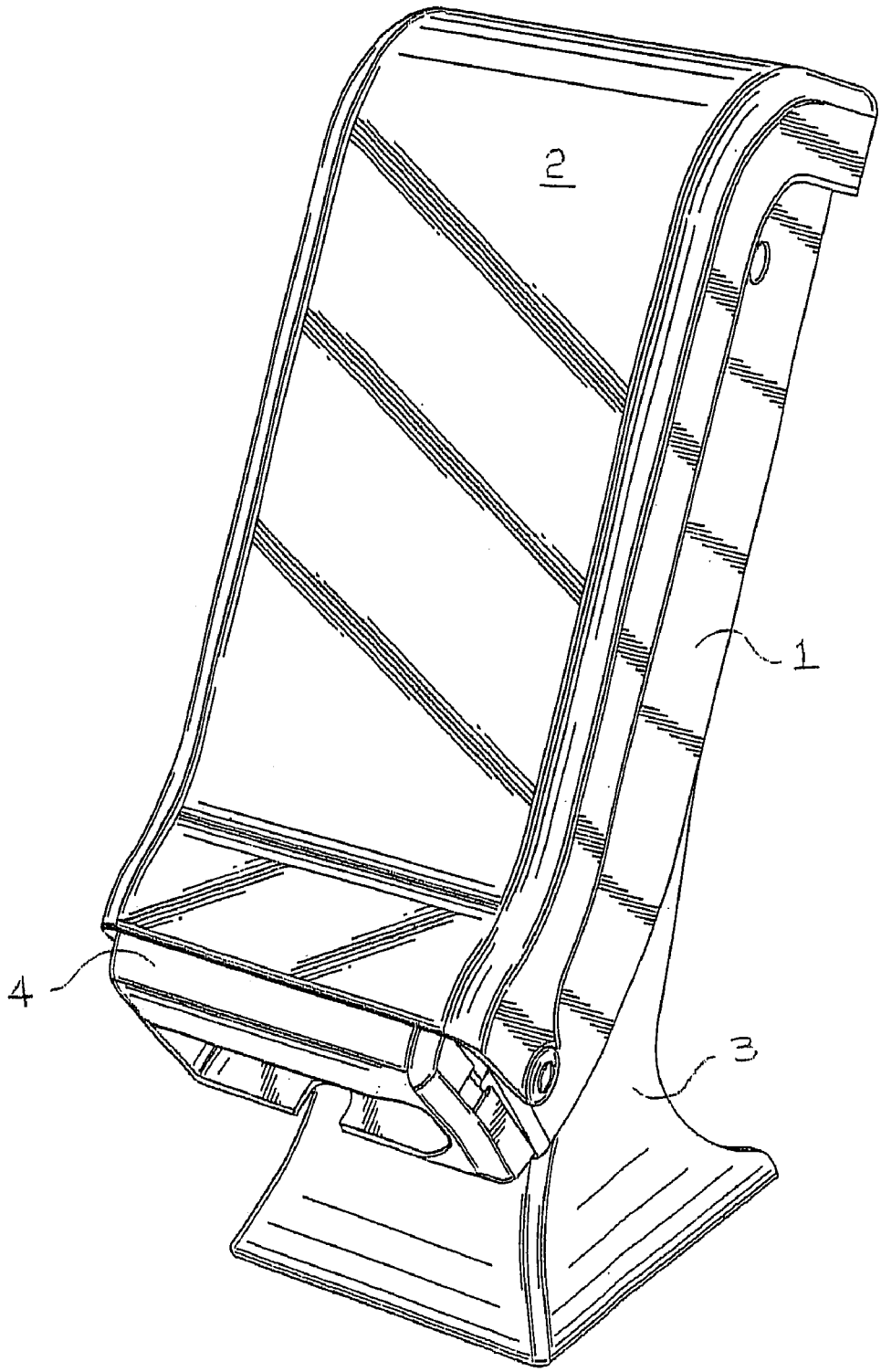
FIG. 1 is a perspective view showing an embodiment of a dispenser according to the present invention, with a one-by-one face plate attached.

FIG. 1 shows a dispenser according to an embodiment of the invention. The FIG. 1 embodiment is intended to dispense paper napkins, but it will be appreciated that the dispenser according to the invention could also be used to dispense paper towels or tissues or other absorbent sheet products.

The term "absorbent sheet products" as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material comprising at least 30% by weight pulp fibers and at least 20% by weight manmade fibers or filaments.

Figure 3:
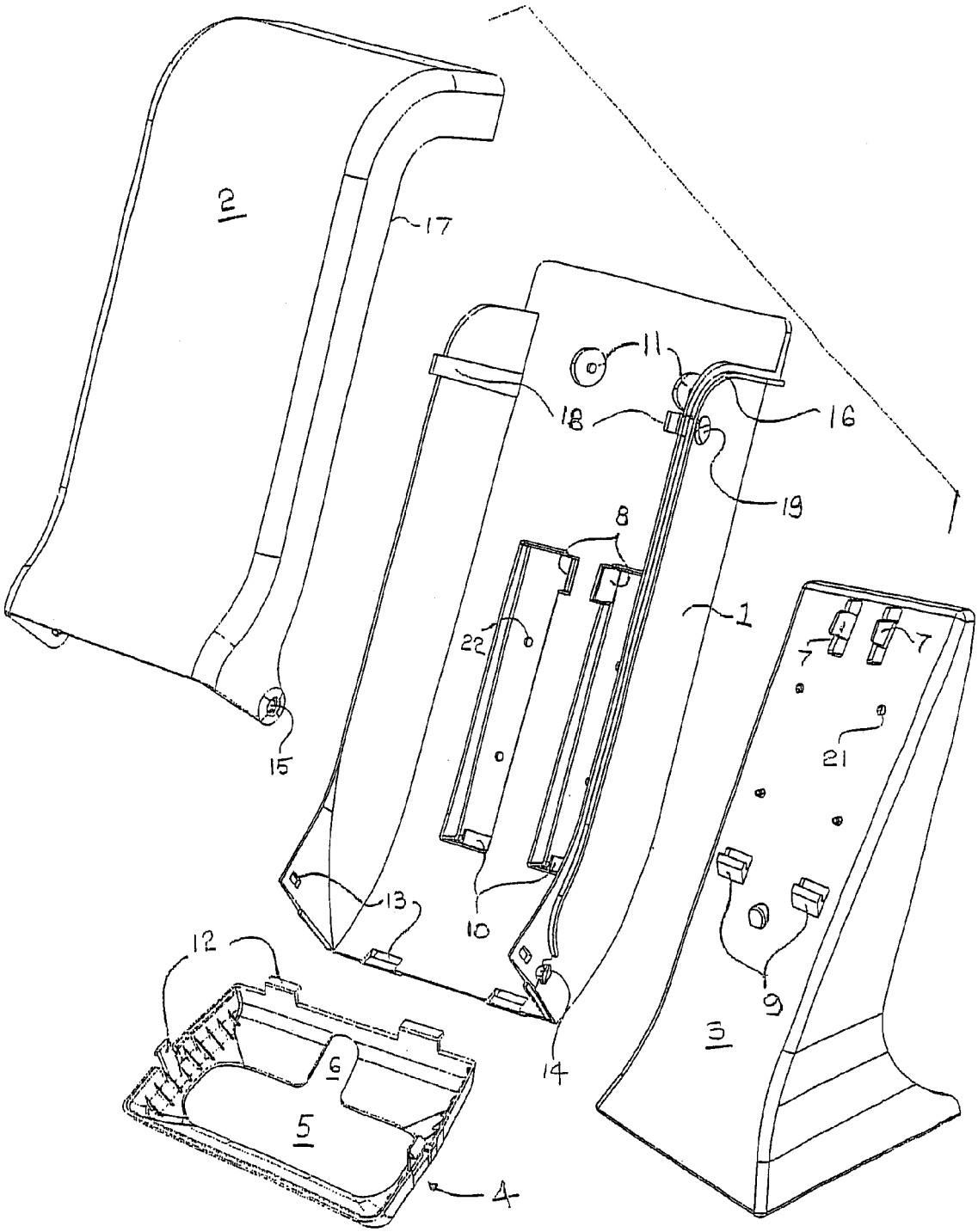
FIG. 3 is an exploded perspective view showing the principal components of the dispenser according to FIG. 1.

The principal components of the dispenser in this embodiment include a main dispenser body portion 1, which terminates downwardly in a faceplate 4 having a dispensing opening through which napkins are withdrawn one-by-one. According to the invention, the faceplate 4 is removable from the body portion 1, for example as shown in FIG. 3.

A cover 2 closes the front of the main body portion 1, and is openable to permit reloading of fresh napkins into the main body portion 1. The cover 2 is preferably transparent, so that the quantity of napkins remaining in the dispenser can be observed without the need to open the same; whereas the main body portion 1 is preferably opaque.

A stand 3 supports the dispenser on an underlying horizontal surface, and also positions the dispenser at the desired angle relative to such surface. The stand 3 is preferably also removable from the body portion 1, as shown in FIG. 3, which provides advantages discussed herein; however, the stand 3 could also be formed in one piece with, or permanently secured to, the main body portion 1.

Figure 2:
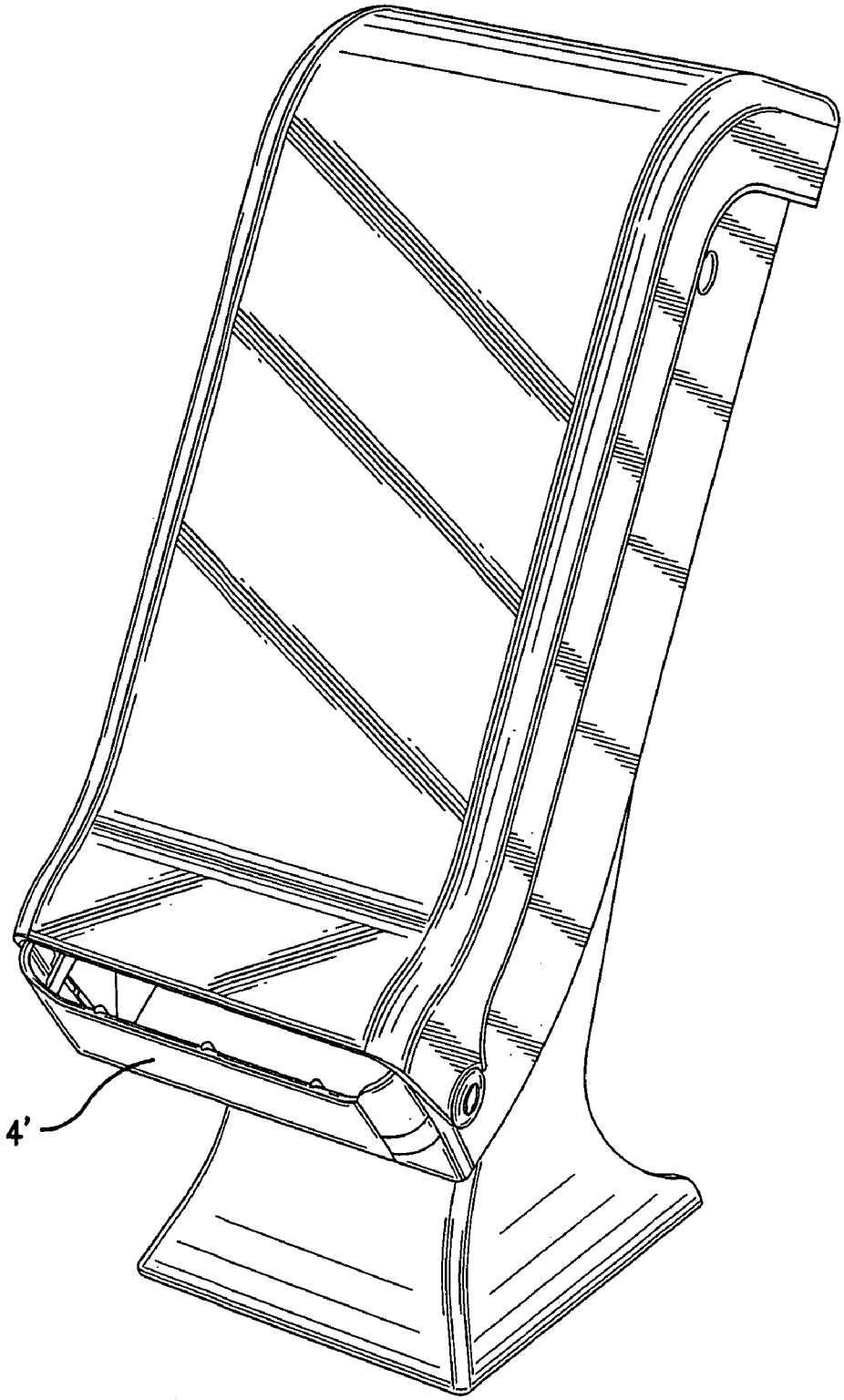
FIG. 2 is a perspective view of the dispenser of FIG. 1, but with a group-dispensing face plate attached

In FIG. 2, the dispenser of FIG. 1 is modified only in that the face plate 4 of FIG. 1 has been removed and replaced by a face plate 4'. The face plate 4' is designed to permit groups of absorbent sheet napkins to be withdrawn from the dispenser simultaneously.

The dispenser body and stand shown in the Figures and to which the interchangeable face plates 4, 4' are secured, is that presently preferred by the inventors; however, the invention is applicable to a variety of other dispenser shapes and types; consequently, the accompanying claims are not intended to be limited to any particular dispenser shape or type, unless the claim so states.

The exploded view of FIG. 3 shows a number of advantageous structural details of the FIG. 1 embodiment. All of the components are preferably formed of injection-molded plastic. The various connecting structures of the component parts thereby have sufficient inherent resiliency to deform enough to enter the mating parts on the adjacent component, for ease of assembly and disassembly.

The transparent cover 2 is connected to the main body portion 1 via the slotted openings 15, which fit over the flanged bosses 14 formed on the main body portion 1. Only one opening/boss pair 14, 15 is visible in FIG. 2; however, the dispenser of this embodiment is symmetrical about a longitudinal bisecting plane parallel to its sides. The cover can be opened by pivoting it about the common axis of the bosses 14 and openings 15. The range of angular movement of the cover 2 relative to the main body portion 1 permits fully exposing the interior of the main body portion 1, thereby to allow unimpeded access for refilling the dispenser.

Cleats 18 snap fit to the inside edge portions of cover 2 to hold the cover in the closed position. Those cleats can be released by exerting inwardly-directed pressure on the depressions 19 formed on the outside of the main body portion 1.

The cover 2 of this embodiment also has an inner width slightly greater than the outer width of the main body portion 1, so that the two components overlap in the closed position. The main body portion 1 therefore includes a laterally-outwardly projecting flange 16 on one or both sides, which registers with the complementary-shaped edge 17 of the cover 2, and serves as a secure stop in the closed position.

The main body portion 1 is closed at its lower end by the one-by-one faceplate 4 having a dispensing opening 5. The faceplate 4 cooperates with the stack of napkins held within the dispenser to permit one-at-a-time dispensing of such napkins, as will be described in greater detail below. The faceplate 4 is detachably connected to the main body portion 1 by resilient cleats 12 that mate with corresponding slots 13 formed on the main body portion 1.

The main body portion 1 is detachably connected to the stand 3 by a combination of brackets 9 on the stand that engage slots 10 on the main body portion 1, resilient cleats 7 on the stand 3 that snap fit into corresponding openings 8 on the main body portion 1, and round projections 21 on the stand 3 that engage openings 22 on the main body portion 1 to ensure a correct positional registration.

The main body portion 1 also includes recessed openings 11 that permit the main body portion 1 to be fastened to a vertical support surface. In that case, the stand 3 would not be used. The dispenser of this embodiment may therefore be positioned on a horizontal surface by using the stand 3, or mounted on a vertical surface, without the stand 3. This is believed to provide a very advantageous measure of versatility for commercial food service establishments, and especially for fast food franchises, in that the dispenser could be used with the stand for indoor countertop use, and outdoors without the stand, fixed to the wall of a drive-through lane. As noted above, the one-by-one face plate 4 will in practice be more suited for use in combination with stand 3 in an indoor countertop environment, whereas the group-dispensing face plate 4' will be more suited to use without the stand, mounted on a vertical surface, as in the drive-through environment.

Figure 4A:
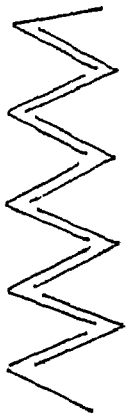
FIG. 4(*a*) is a schematic representation of the interfold configuration of the napkins used in the dispenser of FIG. 1.
Figure 4B:
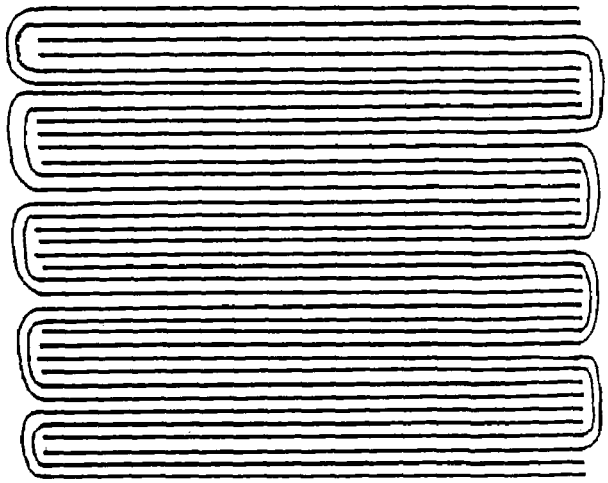

FIGS. 4(*a*) and 4(*b*) show in a schematic manner the napkins that it is presently preferred to use in conjunction with the dispenser of FIGS. 1–3. The napkins are interfolded in the manner illustrated schematically in FIG. 4(*a*). The napkins are preferably entirely separated from one another; however, those skilled in the art will appreciate that the interfolded product illustrated in FIG. 4(*a*) will be produced using two "lanes" or webs of napkin stock, such that alternate napkins may be interconnected by tabs at their adjacent respective leading and trailing edges, with the initial resistance force to withdrawal through the dispensing opening 5 being sufficient to tear the tabs and remove only a single napkin.

Each napkin is preferably "quarter-folded," meaning that it is folded along two perpendicular lines of folding, with each fold line preferably bisecting the sheet. An initial sheet of napkin stock is preferably about 13" by 8⅛", so the folded napkin would have dimensions of about 6½" by 4¼". It is preferred that the napkins be rectangular rather than square as folded, because, although the parallel sides of the interfolded napkin stack are identical, the perpendicular sides are not.

Therefore, the long sides of the folded napkins are parallel to the front and back surfaces of the dispenser, whereas the short sides of the folded napkins are parallel to the left and right sides of the dispenser. An advantage of this arrangement is that the napkin stack cannot be inserted "backward" or "upside-down" into the dispenser, as there is no distinction between the top and bottom of the napkin stack or between the parallel sides thereof.

FIGS. 4(*a*) and 4(*b*) are taken in planes parallel to the short sides of the napkin stack. FIG. 4(*b*) illustrates the point that each napkin is folded not only as shown in the figure, but also about a perpendicular line of folding parallel to or coincident with the plane of the drawing. Therefore, the folds visible in FIGS. 4(*a*) and 4(*b*) are those extending across the long dimension of the napkins, whereas the folds not visible are those extending across the short dimension of the napkins.

A quarter-fold interfolded arrangement has been described before in connection with pop-up tissue dispensers (see EP 0 286 538 B1 and EP 0 302 382 A1), but not previously for napkins in a gravity-fed, downwardly opening dispenser. Such a napkin is expected to be regarded by users as being of relatively high quality, because the presence of four panels permits conferring sufficient aggregate strength and flexibility to the napkin while using stock web material having a relatively low basis weight, which confers advantageous properties of drape and hand feel to the napkin.

In use, the napkin stack is loaded into the dispenser with the cover 2 in open position, after which the cover 2 is closed. When the one-by-one face plate 4 is used, a first napkin is withdrawn in whole or in part through the dispensing opening 5, with the aid of the side extension 6 thereof. The interfolding causes two adjacent panels of the next napkin to project through the dispensing opening, such that a user will be able to take only one napkin at a time. This dispensing mode discourages users from withdrawing more napkins than are needed, and correspondingly reduces waste.

When the dispenser is almost empty, the transparent cover 2 will reveal that condition to employees of the establishment, so that the dispenser can be refilled.

Figure 5:
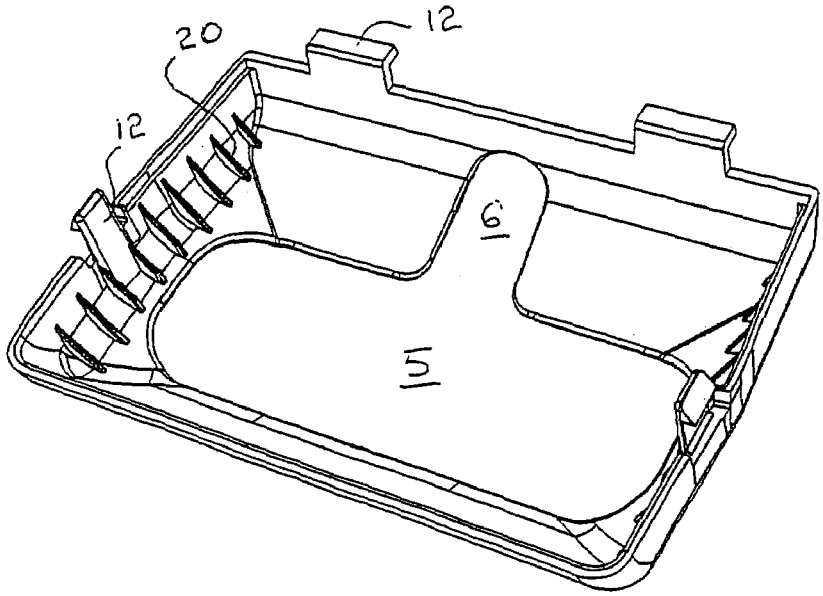
FIG. 5 is a perspective view showing the inwardly facing surfaces of the one-by-one face plate of FIG. 1.

FIG. 5 shows the one-by-one face plate in greater detail. The large portion of opening 5 underlies the bottom of the napkin stack in the dispenser, such that a part of only one napkin normally projects therethrough. While part of a second napkin may be visible through the opening, the projecting portion of only a single napkin means that, as a practical matter, a user will not attempt to withdraw more than one napkin at a time. Ribs 20 on the interior of face plate 4 provide a support and guide surface for the short sides of the napkin stack, as illustrated in FIGS. 4(*a*) and 4(*b*).

Figure 6:
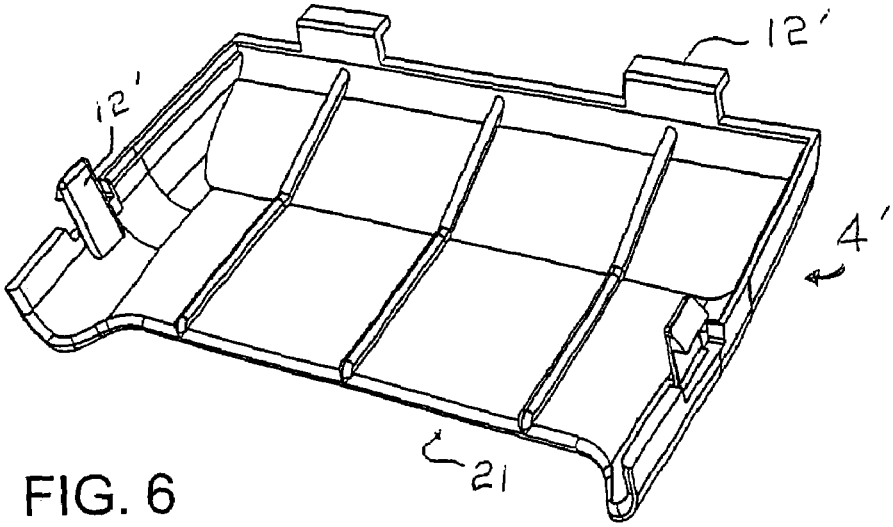
FIG. 6 is a perspective view showing the inwardly facing surfaces of the group-dispensing face plate of FIG. 2.
Figure 7:
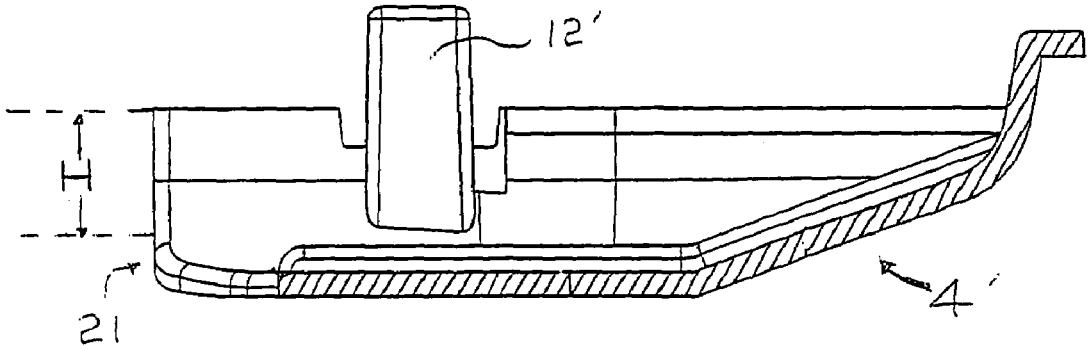
FIG. 7 is a sectional view taken along the plane of symmetry of the face plate of FIG. 6.

From FIGS. 2, 6 and 7, on the other hand, it is apparent that the lateral opening 21 in the group-dispensing face plate 4' will expose the side region of the napkin stack, and hence the edges of a plurality of napkins. It will be noted that face plate 4' preferably has the same general peripheral dimensions as face plate 4, and cleats 12' are preferably positioned in the same locations and are preferably of the same size as cleats 12, to ensure that the face plate 4' can be readily snapped into position in place of face plate 4.

From FIG. 7, it is apparent that the opening 21 in face plate 4' has an extent H along the direction of travel of the napkin stack, such that a plurality of napkins can be withdrawn simultaneously. The dimension of H can be varied widely, but it is presently preferred that the dimension be such that a user can withdraw from abut 4 to about 10 napkins simultaneously, preferably from about 6 to about 8 napkins. With reference to FIG. 4(*b*), it will be appreciated that each napkin "edge" exposed through opening 21 in face plate 4' is actually the fold of one napkin enveloping the contiguous panels of an upper napkin and a lower napkin. Therefore, in practice, for each "edge" that the user pulls through opening 21, he will withdraw two napkins, when an interfolded stack as shown in FIGS. 4(*a*) and 4(*b*) is used in combination with the dispenser.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A dispenser for folded absorbent sheet products, comprising a container body for holding a stack of said absorbent sheet products, said container body comprising a main body portion, a cover and at least two interchangeable injection-molded plastic components each connectable to said main body portion and each, when connected to said main body portion, partially closing said container at one end, the container body comprising two sections, wherein a first upstream one of said sections is straight and extends over the majority of the length of said container body, and wherein a second downstream one of said sections extends at an angle relative to said first section and communicates with a dispensing opening defined by a respective one of said at least two interchangeable injection-molded plastic components, said second downstream one of said sections comprising first and second long sides respectively adjacent and opposite said cover and first and second short sides interconnecting said first and second long sides, a first of said interchangeable injection-molded plastic components having a first elongated dispensing opening disposed, when connected to said main body portion, intermediate said first and second long sides of said second downstream one of said sections, and a second of said interchangeable injection-molded plastic components having a second elongated dispensing opening disposed, when connected to said main body portion, relatively nearer to said first long side of said second downstream one of said sections.

2. The dispenser according to claim 1, further comprising a stack of folded absorbent sheet products disposed within said container body.

3. The dispenser according to claim 2, wherein said stack of folded absorbent sheet products are interfolded paper napkins.

4. The dispenser according to claim 3, wherein said paper napkins are each quarter-folded.

5. The dispenser according to claim 1, further comprising a stand having a base for supporting the dispenser on a horizontal surface.

6. The dispenser according to claim 5, wherein said stand is detachable from said body.

7. The dispenser according to claim 6, wherein said body comprises mounting structures for mounting said body on a vertical surface.

8. The dispenser according to claim 7, wherein said mounting structures for mounting said body on a vertical surface comprise at least two openings formed in a rear wall of said body, for receiving bolts securing said body to said vertical surface.

9. The dispenser according to claim 1, wherein said cover is openable in relation to the main portion to expose an interior of said main portion.

10. The dispenser according to claim 9, wherein said cover is transparent.

11. The dispenser according to claim 10, wherein said main portion is opaque.

* * * * *